US007988505B2

(12) United States Patent
Hotea et al.

(10) Patent No.: US 7,988,505 B2
(45) Date of Patent: Aug. 2, 2011

(54) VIBRATION-DAMPING CONTACT ELEMENT

(75) Inventors: Gheorghe Hotea, Griesheim (DE); Hannes Wendling, Langen (DE); Waldemar Stabroth, Mommenheim (DE); Stefan Glaser, Heppenheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/757,719

(22) Filed: Apr. 9, 2010

(65) Prior Publication Data

US 2010/0197178 A1 Aug. 5, 2010

Related U.S. Application Data

(63) Continuation of application No. PCT/EP2008/008583, filed on Oct. 10, 2008.

(30) Foreign Application Priority Data

Oct. 11, 2007 (DE) ..... 10 2007 049 055

(51) Int. Cl.
*H01R 13/11* (2006.01)

(52) U.S. Cl. ..... 439/852

(58) Field of Classification Search ..... 439/837–852, 439/746, 748

See application file for complete search history.

(56) References Cited

U.S. PATENT DOCUMENTS 2,549,577 A * 4/1951 Coyle ..... 439/843
4,472,017 A 9/1984 Sian
4,934,965 A * 6/1990 Buddrus et al. ..... 439/845
5,607,328 A * 3/1997 Joly ..... 439/852
5,611,717 A 3/1997 Joly
5,695,368 A * 12/1997 Joly et al. ..... 439/748
5,954,548 A * 9/1999 Stabroth ..... 439/839
6,042,433 A * 3/2000 Chen ..... 439/852

(Continued)

FOREIGN PATENT DOCUMENTS

DE 69312027 T2 6/1994

(Continued)

OTHER PUBLICATIONS

International Search Report for co-pending International Application No. PCT/EP2008/008583, dated Jan. 21, 2009, 2 pages.

(Continued)

*Primary Examiner* — Briggitte R Hammond
(74) *Attorney, Agent, or Firm* — Barley Snyder LLC

(57) ABSTRACT

The invention relates to a terminal for an electrical connector. The terminal includes, an outer body, a connector section, a crimping section, a contact retention section, a contact receiving area, and at least one main contact spring. The connector section is positioned to receive an pin that is insertable into the terminal. An electrical conductor is attachable in an electrically conductive manner to the crimping section. The outer body is retained in the contact retention section and fitted as a separate component. The at least one main contact spring includes a free end and at least one support area, and projects into the contact receiving area for the pin. Furthermore, the at least one main contact spring provides a contact force on the pin along a main spring path extending substantially transversely to the insertion direction of the connector section. The at least one main contact spring extends substantially in the insertion direction. The free end of the at least one main contact spring is directed substantially away from a contact opening of the connector section, while the at least one support area rests against the terminal in an inserted position.

30 Claims, 7 Drawing Sheets

U.S. PATENT DOCUMENTS

| | | | | |
|---|---|---|---|---|
| 6,186,840 | B1 | 2/2001 | Geltsch et al. | |
| 6,394,858 | B1 * | 5/2002 | Geltsch et al. | 439/852 |
| 6,733,318 | B2 | 5/2004 | Myer et al. | |
| 6,872,103 | B1 * | 3/2005 | Flieger et al. | 439/839 |
| 7,004,797 | B2 * | 2/2006 | Harada et al. | 439/857 |
| 7,252,559 | B1 * | 8/2007 | Morello et al. | 439/843 |
| 7,387,550 | B2 * | 6/2008 | Myer et al. | 439/852 |
| 7,419,410 | B2 * | 9/2008 | Myer et al. | 439/852 |
| 2001/0051464 | A1 | 12/2001 | Kodama | |

FOREIGN PATENT DOCUMENTS

| | | | |
|---|---|---|---|
| DE | 69313794 | T2 | 6/1994 |
| DE | 19625847 | A1 | 1/1997 |
| DE | 10138755 | A1 | 2/2003 |
| DE | 69907641 | T2 | 4/2004 |
| DE | 102006009357 | B3 | 9/2007 |
| EP | 1091449 | A3 | 4/2001 |
| EP | 1271702 | A2 | 1/2003 |
| EP | 1746687 | B1 | 7/2010 |

OTHER PUBLICATIONS

German Search Report cited in co-pending German Application No.: 10 2007 049 055.2-34, issued Oct. 11, 2001, 6 pages.

PCT International Preliminary Report on Patentabilitycited in co-pending International Application No.: PCT/EP2008/002170, issued Oct. 27, 2009, 1 page.

PCT Written Opinion cited in co-pending International Application No.: PCT/EP2008/002170, issued Oct. 27, 2009, 5 pages.

* cited by examiner

A-A

C-C

B-B

VIBRATION-DAMPING CONTACT ELEMENT

CROSS-REFERENCE TO RELATED APPLICATIONS

This application is a continuation of PCT International Application No. PCT/EP2008/008583, filed Oct. 10, 2008, which claims priority under 35 U.S.C. §119 to German Patent Application No. DE 10 2007 049 055.2, filed Oct. 11, 2007.

FIELD OF THE INVENTION

The invention relates to a an electrical connector terminal.

BACKGROUND

It is well known to have terminals permanently connected to an electrical conductor, and then inserted into an associated connector or a receiving device. There, the terminals receive pins of a mating connector, in order to connect these electrically to the electrical conductors connected to the terminals. It is essential, in this case, to contact and retain the pins inserted into the terminal as reliably as possible in the inserted state, it being necessary to ensure that the insertion forces are not so great or act so unfavorably on the pin as to hinder insertion of the pin.

If the terminals are used in vehicles or machinery with moving parts, problem arise and are associated with mechanical vibrations or oscillations acting on the terminal and the electrical conductor connected thereto. In the terminal, the vibrations may propagate into the connector section, where the vibrations may cause wear to the contact points of the pin and to the terminal. Furthermore, the connection may be interrupted as soon as the vibration forces become greater than the retaining forces applied by the terminal.

SUMMARY

It is an object of the invention to provide an improved terminal which securely retains an inserted pin, while minimizing the impact of vibrations.

The terminal includes an outer body, a connector section, a crimping section, a contact retention section, a contact receiving area, and at least one main contact spring. The connector section is positioned to receive a pin that is insertable into the terminal. An electrical conductor is attachable in an electrically conductive manner to the crimping section. The outer body is retained in the contact retention section and fitted as a separate component. The at least one main contact spring includes a free end and at least one support area, and projects into the contact receiving area for the pin. Furthermore, the at least one main contact spring provides a contact force on the pin along a main spring path extending substantially transversely to the insertion direction of the connector section. The at least one main contact spring extends substantially in the insertion direction. The free end of the at least one main contact spring is directed substantially away from a contact opening of the connector section, while the at least one support area rests against the terminal in an inserted position.

BRIEF DESCRIPTION OF THE DRAWINGS

Further details, advantages and features of this invention are given in the following description of an embodiment, in association with the drawings. In these drawings.

DETAILED DESCRIPTION OF THE EMBODIMENT(S)

Figure 1:
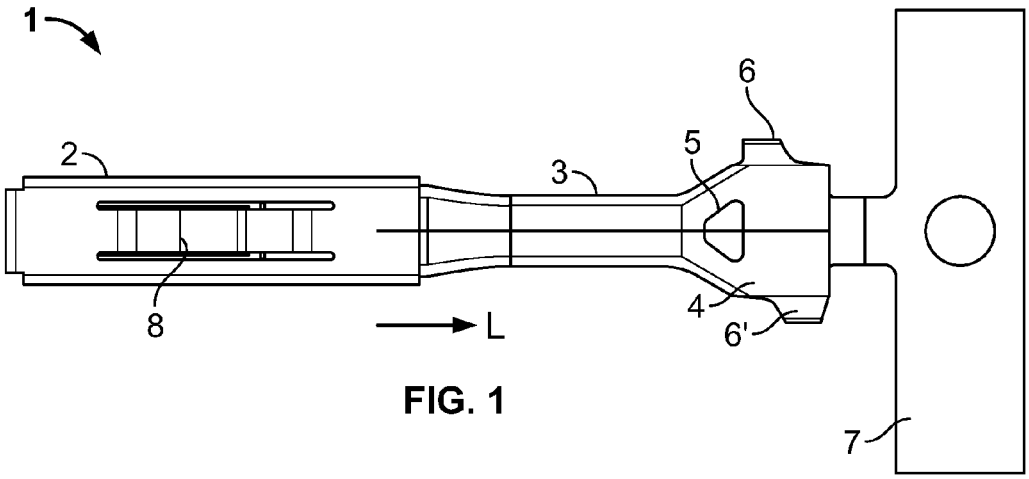
FIG. 1 is a plan view of a terminal according to the invention.

The invention will be described in detail in the following with reference to the figures, which are shown in the drawings and are embodiments of the present invention. In the drawings:

With reference to FIG. 1, a terminal 1 is shown having a connector section 2 for receiving a pin (not shown here). The connector section 2 connected through a collar 3 to a crimping section 4 or receptacle for attaching an electrical conductor (not shown).

The crimping section 4 is provided with an opening 5, which simplifies the attachment of an electrical conductor (not shown) to the crimping section 4. In addition, the crimping section 4 has a crimping sidewalls 6 and an insulation crimp section 6', by means of which an electrical conductor (not shown) and its insulation may be secured and electrically connected to the crimping section 4.

In addition, the terminal 1 is provided with a carrier 7, which simplifies mechanical handling of the terminal 1.

Located on the connector section 2 is a resilient platelike cantilever 8, which simplifies attachment to the terminal 1 of an outer body 9 or over-spring covering the connector section 2, At the same time, the resilient platelike cantilever 8 may be used to increase retention forces acting on a pin (not shown here) inserted into the connector section 2. The resilient platelike cantilever 8 provides additional flexibility when supporting the main contact spring 23.

Figure 2:
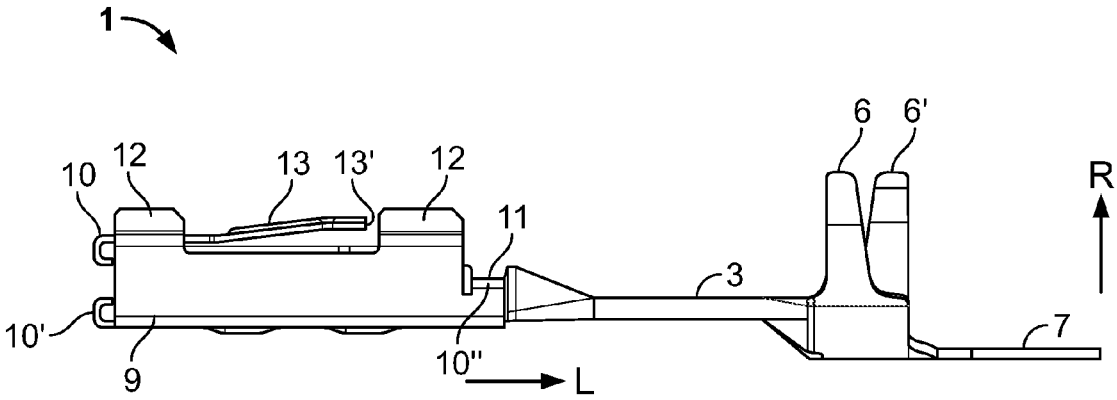
FIG. 2 is a side view of a terminal according to the invention with an outer body positioned thereon.

With reference to FIG. 2, the terminal 1 is shown having an outer body 9 fitted thereto. The outer body 9 grips loosely around the terminal 1 with clamps 10, 10' and is fastened to the terminal 1 by means of the clamp 10". In order to simplify fastening of the outer body 9 to the terminal 1, clamp recesses 11 are formed on the terminal 1. The clamp 10" may more readily grip around the terminal 1 without slipping in a longitudinal direction L of the terminal 1, as a result of the clamp recesses 11.

In addition, the outer body 9 has positioning guides 12, which simplify correct insertion and locking of the terminal 1 in a connector (not shown). Additionally, the outer body 9 protects the terminal 1 from damage, wherein a latching spring or latching arm 13 serves to fasten the terminal 1 in a connector (not shown). The free end 13' of the latching arm 13 is movable in a latching direction R extending transversely of the longitudinal direction L, and serves to latch the terminal 1 in a connector, in that it engages behind a catch projection arranged thereon.

In addition, the side view in FIG. 2 of the terminal 1 according to the invention makes clear the arrangement of the collar 3, of the crimping sidewalls 6, of the insulation crimp section 6' and of the carrier 7, which are connected together substantially rigidly.

Figure 3:
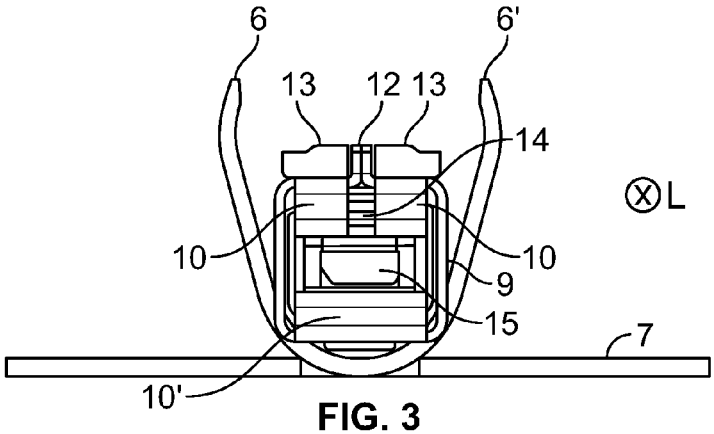
FIG. 3 is a front view of a terminal according to the invention with an outer body positioned thereon.

With reference to FIG. 3, the terminal 1 is shown with an outer body 9 fitted thereto. The clamps 10, 10' of the outer body 9 are clearly shown gripping around an edge 14 of a contact opening 15 for receiving an pin (not shown here) in the connector section 2. The clamps 10, 10' not only protect the edge 14 on insertion of the pin (not shown here), but also simplify the insertion process.

It is additionally clear that the latching arm 13 are divided in two, in a longitudinal direction L of the terminal 1, and the positioning guides 12 are arranged centrally between the latching arms 13. The free latching end 13' is movable in a latching direction R extending transversely of the longitudinal direction L.

Figure 4:
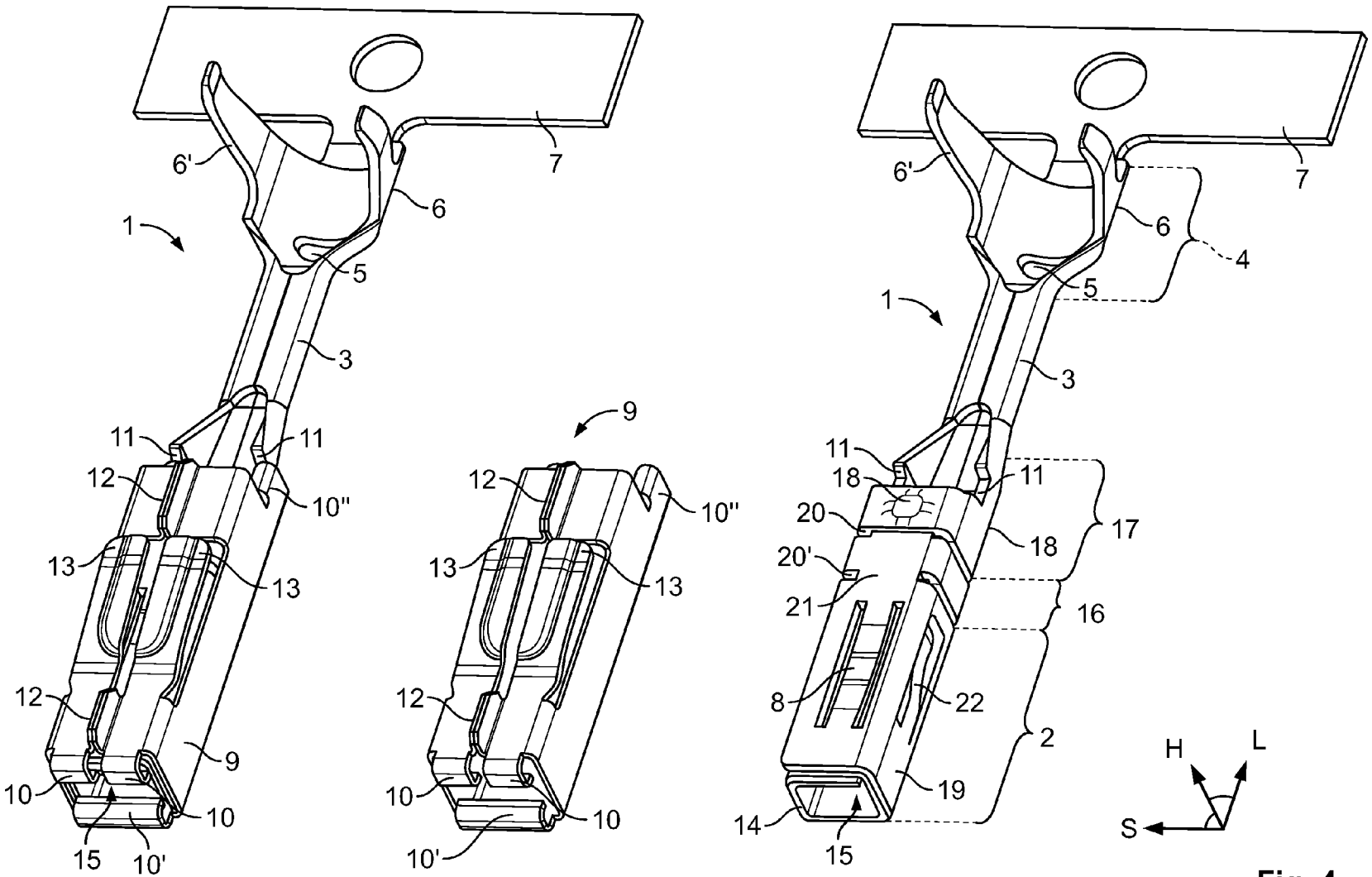
FIG. 4 is a perspective view of a terminal according to the invention with and without an outer body positioned thereon and a schematic perspective view of an outer body for a terminal according to the invention.
Figure 5:
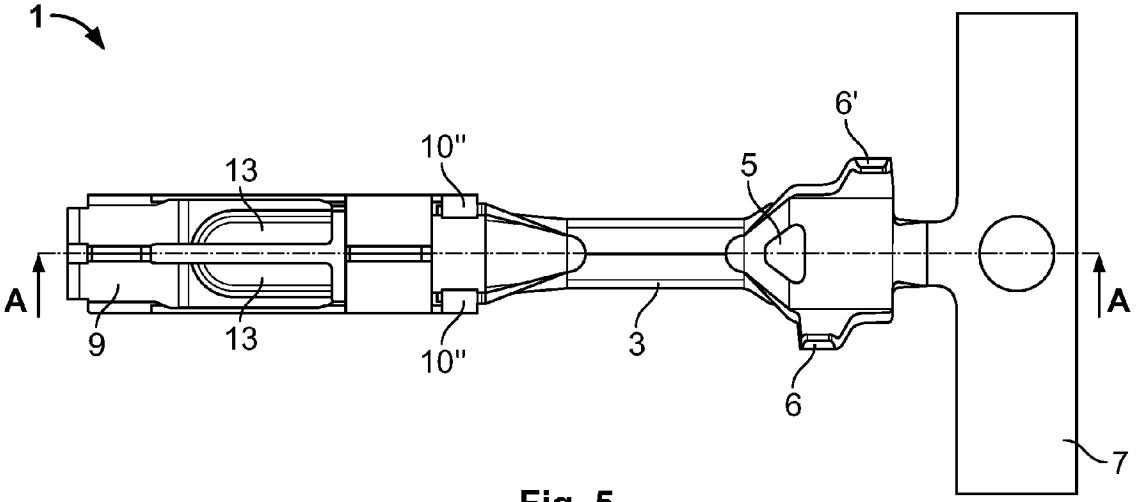
FIG. 5 is a plan view of a terminal according to the invention with an outer body positioned thereon.

FIG. 4 shows two terminals 1 according to the invention, one with the outer body 9, as well as another terminal 1 with the separated outer body 9 to the side. It is made clear by the terminal 1 shown in FIG. 4 how the terminal 1 is sectioned into the connector section 2, a weakened or stretching or straining zone 16, a contact retention section 17 and a crimping section 4 connected rigidly to the contact retention section 17 through the collar 3. In the contact retention section 17, the clamp recesses 11 and retaining points 18 are formed, which serve to fasten the terminal 1 in its mounting position or to couple rigidly to the terminal 1 the outer body 9 serving to mount the terminal 1. It is however essential to prevent vibrations in the contact retention section 17 using the collar 3, as well as the retaining points 18 and clamp recesses 11 from being relayed to the connector section 2, since this could lead to damage or incorrect contacting of a pin (not shown here) inserted into the connector section 2.

In order to prevent or reduce the transmission of oscillations or vibrations between the contact retention section 17 and the connector section 2, notches 20, 20' are positioned along the body 19 of the terminal 1 to provide the straining zone 16. The material of the body 19 left in the area of the notches 20, 20' serves as a flex point or material bridge forming an articulating connection. Thus, in a first advantageous development the connector section 2 and the contact retention section 17 are connected together in an articulated manner, the contact retention section 17 and the crimping section 4 being connected together substantially rigidly with regard to movement. This configuration has the advantage that vibrations acting on the contact retention section 17 directly or through the crimping section 4 may be kept away or isolated from the connector section 2, because they can only penetrate with difficulty into the connector section 2 through the articulated connection.

The articulated connection may take the form of a flex point formed in one piece from the connector section 2 and the contact retention section 17. In this way, both the material of the terminal 1 and an otherwise electrically conductive material may be used. Depending on the particular requirements, the flex point may be so shaped that it ensures the desired vibration isolation between connector section 2 and contact retention section 17 or even the absorption of vibrations occurring at that point and simultaneously fulfils stability requirements corresponding to the particular conditions of use. The one-piece configuration of connector section 2 and contact retention section 17 ensures constant contacting and helps to avoid connection points liable to damage.

Vibration isolation may be simply achieved in particular when the articulated connection takes the form of a substantially planar material bridge. Vibration relaying is hindered in particular for vibrations extending transversely of or perpendicularly to the planar material bridge.

In the articulated connection, the cross-section of the terminal 1 may be reduced at least relative to the other regions of the connector section 2. Thus, any vibration forces and resultant stresses are concentrated in the zone of reduced cross-section and the resilience of the material of the terminal 1 may be utilised for vibration isolation and absorption.

The straining zone 16 may be formed by at least one articulated connection, in which zone deflectability is increased relative to the deflectability of the connector section 2 and of the contact retention section 17 at least in a longitudinal direction of the terminal 1, and deformation occurring as a result of relative motion between connector section 2 and retaining area is concentrated.

The straining zone 16 may be designed in such a way that it may isolate vibration waves passing both longitudinally and transversely through the terminal 1 from the connector section 2 or absorb them before they reach the connector section 2.

Since the notches 20, 20' are positioned along the body 19 of the terminal 1 in the vertical direction H in each case from above and below, when viewed in the lateral direction S a serpentine profile or a deflection is obtained in the portions of the terminal 1 holding the connector section 2 in the damping or straining zone 16. Since the body 19 is also slightly recessed or weakened in the lateral direction S in the area of the notches 20, 20', greater resilience is provided in the area of the straining zone 16 in all three spatial directions, i.e. in the longitudinal direction L, in the vertical direction H and in the lateral direction S, than in the other areas of the body 19.

It is additionally clear from FIG. 4 that the connector section 2 of the body 19 of the terminal 1 has an auxiliary contact spring 22 at the side, which like the resilient platelike cantilever 8 projects into the inside of the connector section 2, in order to retain the pin (not shown here).

FIG. 4 also shows how the outer body 9 grips with its clamps 10, 10', 10" around the edge 14 of the contact opening 15 and the clamp recesses 11 on the terminal 1, respectively. (see also FIG. 6)

Figure 6:
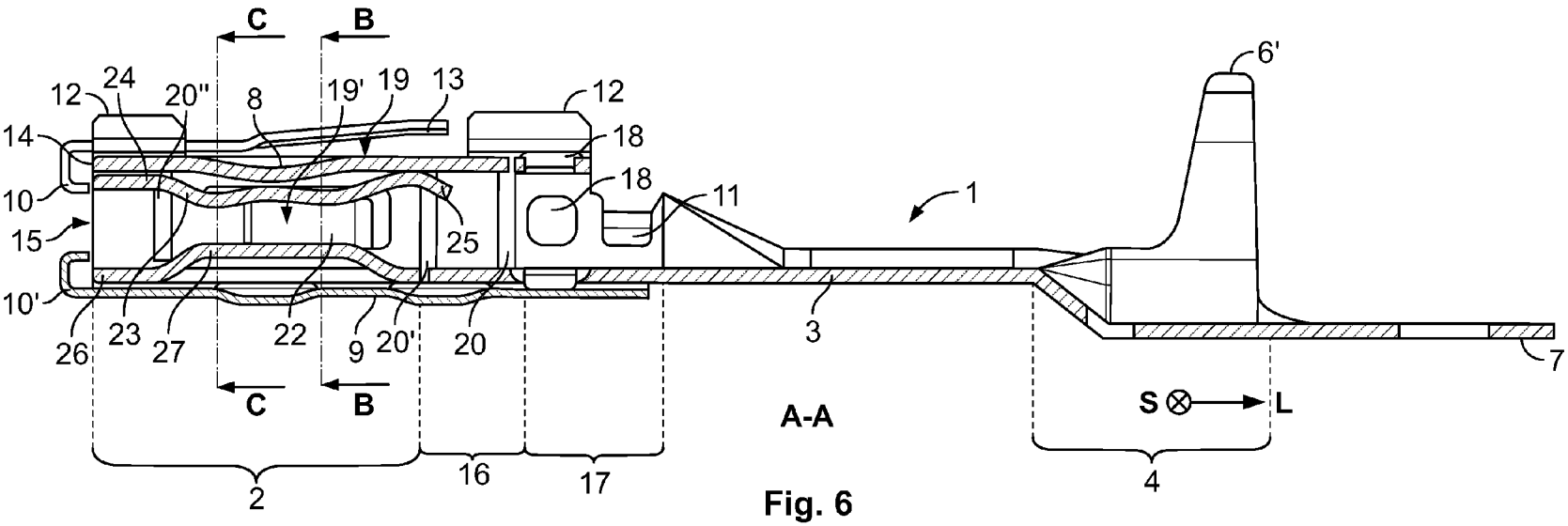
FIG. 6 is a longitudinal sectional view through a terminal according to the invention with outer body positioned thereon, along section line A-A in FIG. 5.

With respect to FIG. 6, the inside of the body 19 shown in longitudinal section includes a main contact spring 23 arranged in the connector section 2 and projects into a contact receiving area 19' for a pin (not shown here). The main contact spring 23 is fastened in the area of its root 24 to the body 19 in the connector section 2 and projects with its free end in the longitudinal direction L as far as into the straining zone 16. Opposite the main contact spring 23 in the contact receiving area 19', the base 26 of the terminal 1 is bent in a contacting area 27 towards the main contact spring 23 so as to project into the contact receiving area 19'. An pin (not shown here)

may thus be retained in the connector section 2 in the contacting area 27 between the base 26, the main contact spring 23 and the auxiliary contact spring 22. The part of the body 19 connected to the root 24 of the main contact spring 23 is provided with a notch 20", whereby the main contact spring 23 is fastened flexibly in the lateral direction S to the body 19. The contacting area 27 may be so formed that it makes easier absorption at the terminal 1 of the retaining forces exerted by the main contact spring 23 on the pin 30 and locally increases the rigidity of the terminal 1.

As best shown in FIG. 4, the connector section 2 is decoupled from the contact retention section 17 with regard to vibrations by the straining zone 16 formed in the body 19 by the notches 20 and 20'. To prevent vibrations from the contact retention section 17 being introduced along the outer body 9 fitted thereto via the edges 14 of the contact opening 15 into the connector section 2, the clamps 10, 10' of the outer body 9 are not firmly connected to the edge 14, but rather loosely wrap and grip around the edge 14.

Figure 7:
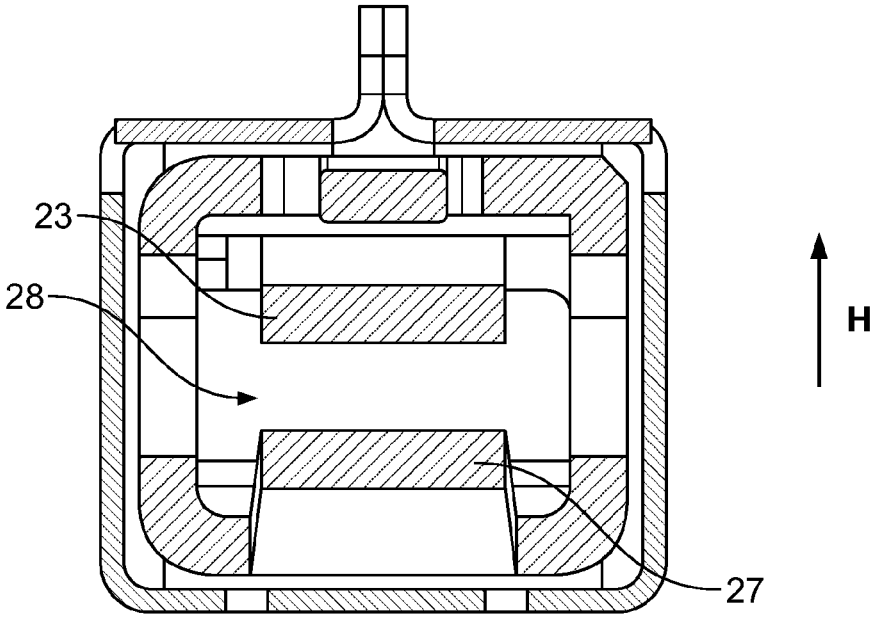
FIG. 7 is a cross-sectional view of a terminal according to the invention with outer body positioned thereon, along section line B-B in FIG. 6.

FIG. 7 makes it clear how the main contact spring 23 and the contacting area 27 of the base 26 face one another in the vertical direction H in a second contact zone 29, so as to retain a pin (not shown here) between them.

Figure 8:
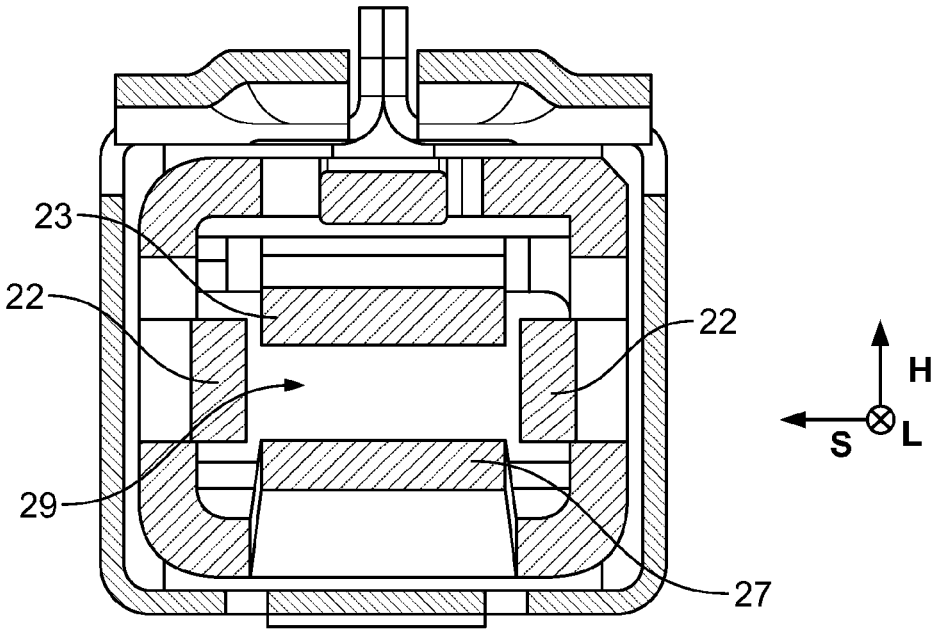
FIG. 8 is a cross-sectional view of a terminal according to the invention with outer body positioned thereon, along section line C-C in FIG. 6.

FIG. 8 clearly shows how the main contact spring 23 and the contacting area 27 of the base 26 in the vertical direction H and the auxiliary contact springs 22 in the lateral direction S face a second contact zone 29, which is located behind the first contact zone 28 in the longitudinal direction L. As a result, a pin (not shown here) is retained there between.

Figure 9:
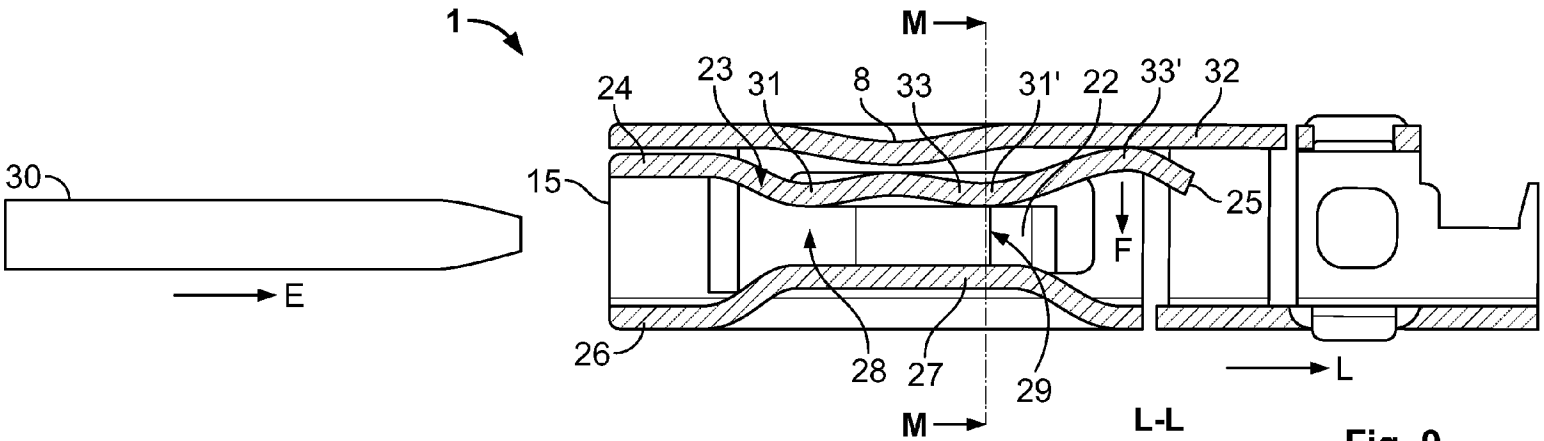
FIG. 9 is a sectional view of a terminal according to the invention and an associated pin.

FIG. 9 shows a terminal 1 according to the invention in an initial position, where the pin 30 is ready to be inserted into the contact opening 15 in the terminal 1 in an insertion direction E parallel to the longitudinal direction L. To hold the pin 30 firm, the main contact spring 23 has contact points 31, 31', bent towards the base 26, i.e. in the main spring direction F, in the area of the first contact zone 28 or the second contact zone 29. Between the contact points 31, 31' the main contact spring 23 has a top support 32, in which it is bent towards the resilient platelike cantilever 8. Near the free end 25 of the main contact spring 23, it is bent towards the top of the terminal 1 in such a way that its support area 33 rests against a top support 32. The contact points 31, 31' may be formed on the at least one main contact spring 23 for contacting the pin 30. A plurality of contact points 31, 31' allows the retention force acting on a pin 30 to be increased. Possible limitation of the retention force which may be produced in a single contact point 31, 31' due to limited flexural strength of the main contact spring 23 may be circumvented by the formation of a plurality of contact points 31, 31' on the main contact spring 23.

The top support 32 may be arranged in the projection of the at least one main contact spring 23 along the main spring deflection path (F), against which top support 32 of the main contact spring 23 rests in an initial position (A). In the initial position (A), the pin 30 has not been inserted into the terminal 1. Prior to insertion of a pin 30, the main contact spring 23 is bias in the direction of a contact receiving area 19' for the pin 30. Thus, a pin 30 to be inserted into the terminal 1 does not have to displace the entire main contact spring 23. Accordingly, insertion of the pin 30 is made easier. Nevertheless, the contact or retaining forces acting on the pin 30 in the inserted state may be kept at a high level in accordance with the particular spring constant, and the total spring displacement determines the retention force.

In addition, the main contact spring 23 rests at the contact point 31' on the auxiliary contact spring 22 functioning as a limit stop and displays pre-tensioning in the direction of the base 26, i.e. in the direction of main spring deflection F. To increase further the retaining or contact forces by biasing the auxiliary contact spring 22, it is possible, according to a further possible advantageous configuration of the terminal 1, for the at least one main contact spring 23 to be a limit stop, located in a projection of the at least one auxiliary contact spring 22 along the spring deflection path F, for the auxiliary contact spring 22, on which the auxiliary contact spring 22 rests in the initial position A.

Vibrations or oscillations may be kept more readily away from the contact points 31, 31' between the main contact spring 23 and the pin 30 in particular when the root 24 of the at least one main contact spring 23, at which the at least one main contact spring 23 is connected to the terminal 1, is arranged in an area which is retained on the connector section 2 by an articulated connection. The articulated connection in the area of the root 24 of the main contact spring 23 may advantageously also be arranged in such a way that it may keep residual vibrations arising in the connector section 2 away from the contact points 31, 31' between the main contact spring 23 and the pin 30. This may be achieved, for example, in that the articulated connection at the root 24 of the main contact spring 23 displays a differently oriented articulation from the articulated connections retaining the connector section 2.

Figure 10:
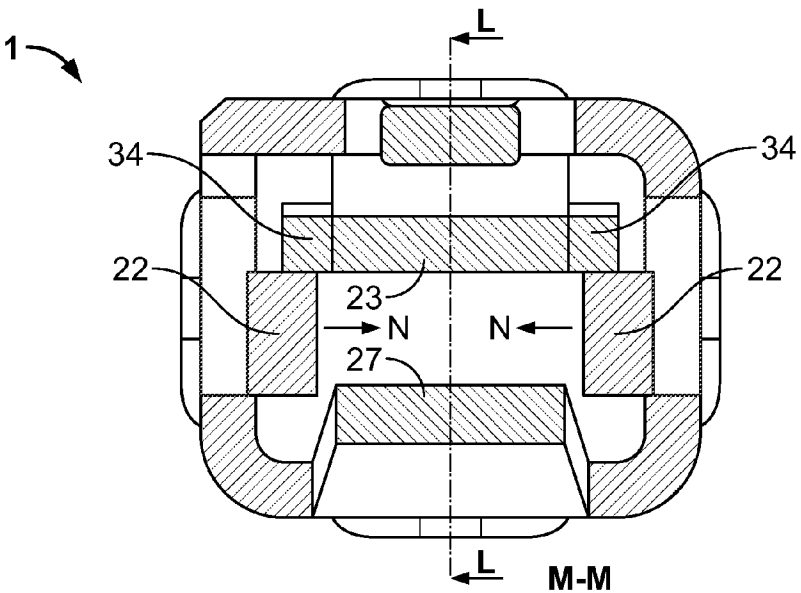
FIG. 10 is a cross-sectional view of a terminal according to the invention, along section line M-M in FIG. 9.

FIG. 10 is a cross-section of a terminal 1 according to the invention taken along section line M-M in FIG. 9, which is within the second contact zone 29 and makes it clear that the main contact spring 23 rests on the auxiliary contact springs 22. The auxiliary contact springs 22 rests on shoulders 34 on the main contact spring 23 and cannot therefore get any closer together. In this way, the shoulders 34 act as limit stops in the auxiliary spring path N of the auxiliary contact springs 22, whereby the auxiliary contact springs 22 are also under pretension. The main contact spring 23 may then readily be held under pretension in particular when at least one shoulder 34 is formed on the at least the main contact spring 23. Thus, the contact surface of the main contact spring 23 does not have to be used to support the main contact spring 23 on the limit stop. Accordingly, the contact surface of the main contact spring 23 or any contact points thereof or its free end may be designed in accordance with the particular requirements, without having in addition to fulfill a second function as a bearing point.

Figure 11:
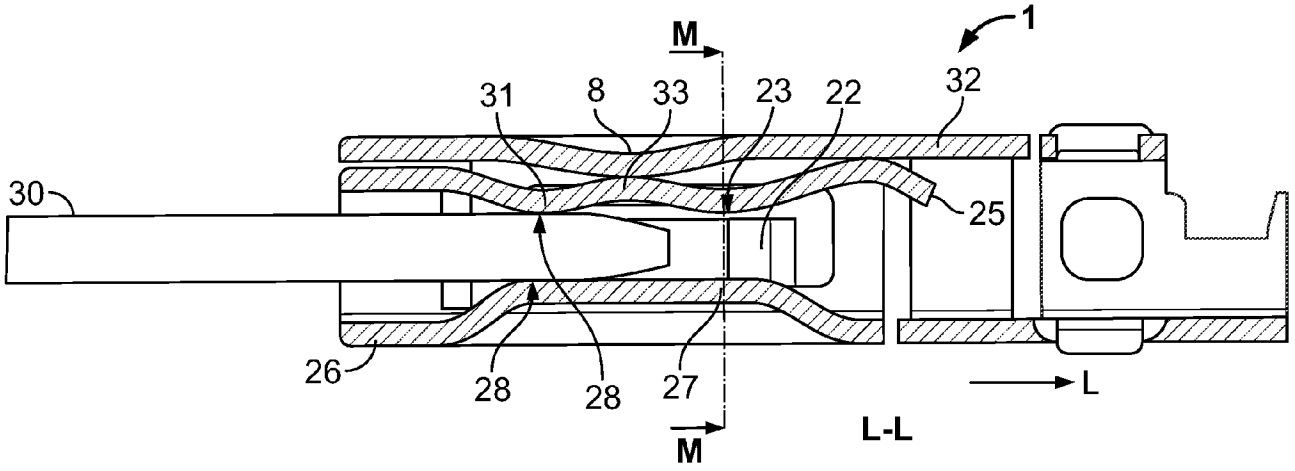
FIG. 11 is a sectional view through a terminal according to the invention with a partially inserted pin.

FIG. 11 shows a terminal 1 according to the invention, into which a pin 30 has been inserted in the longitudinal direction L as far as the first contact zone 28. FIG. 11 makes it clear how the pin 30 is clamped between the first contact point 31 on the main contact spring 23 and the contacting area 27 of the base 26. This causes the main contact spring 23 to deform, such that it is pressed in the area of the bearing against the resilient platelike cantilever 8 at the top support 32 of the terminal 1. Thus the resistance provided by the main contact spring 23 against displacement by the pin 30 is increased and the clamping and contacting forces provided by the main contact spring 23 and acting on the pin 30 are increased.

Figure 12:
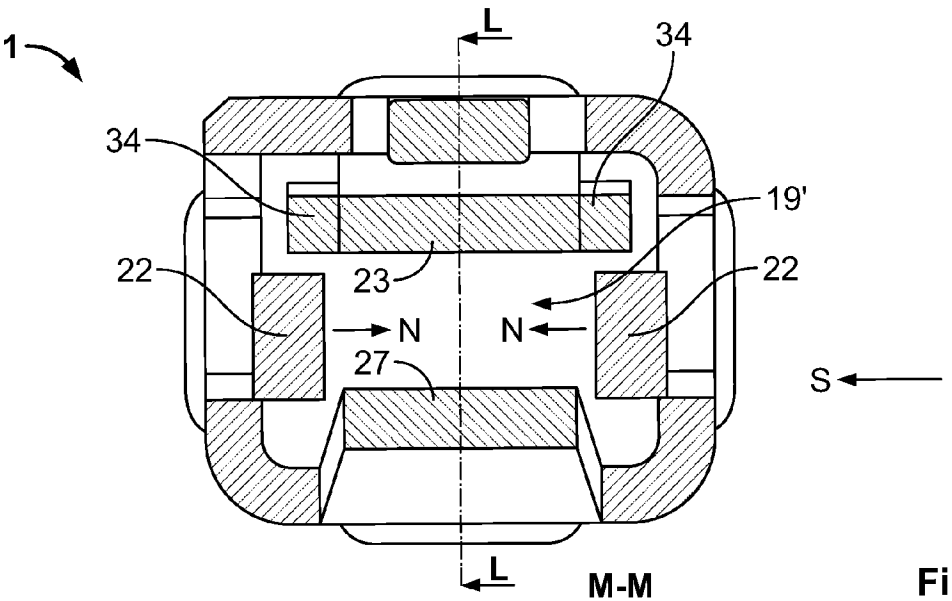
FIG. 12 is a cross-sectional view of a terminal according to the invention with a partially inserted pin, along section line M-M in FIG. 11.

FIG. 12 makes it clear how, in the illustrated second contact zone 29, the main contact spring 23 is lifted away from the auxiliary contact springs 22 when the pin 30 is half-inserted and the shoulders 34 on the main contact spring 23 thus release the auxiliary contact springs 22. The auxiliary contact springs 22 may then clamp the pin 30 between them in the lateral direction S along the auxiliary spring path N.

Figure 13:
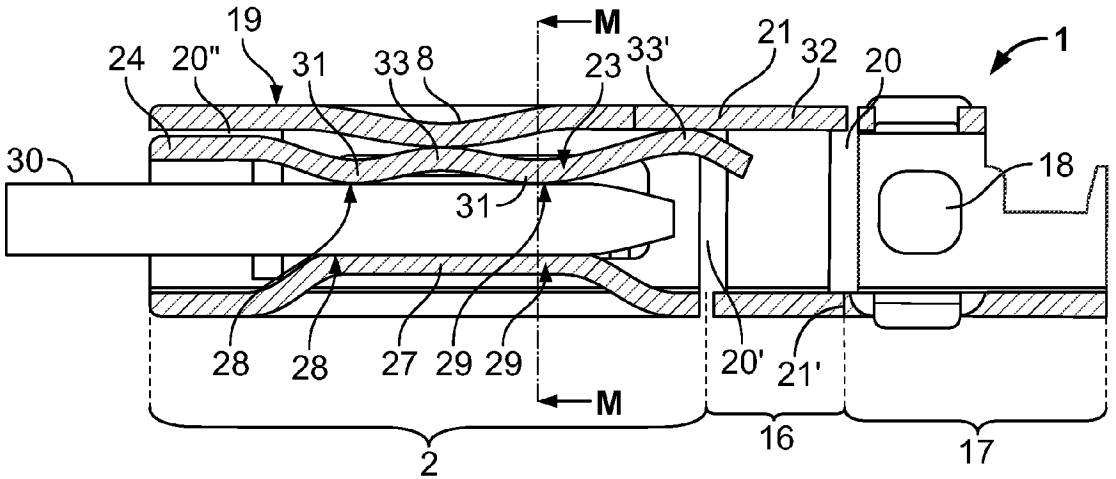
FIG. 13 is a longitudinal section through a terminal according to the invention with a pin inserted to an end position.

FIG. 13 is a longitudinal sectional view of a terminal 1 according to the invention with a pin 30 fully inserted in an inserted position B, and retained in the first contact zone 28 and the second contact zone 29 by the main contact spring 23 by means of the contact points 31, 31' thereof. Both the support area 33 and the support area 33' rest against the top 32 of the terminal 1 or the resilient platelike cantilever 8 and thus assist the main contact spring 23 in retaining the pin 30. At the same time, the main contact spring 23 is separated from the body 19 with regard to vibration by the notch 20" in the area of its root 24. The connector section 2 and thus the body 19 itself are separated from the contact retention section 17 with regard to vibration by the notches 20 and 20' and the resultant flex points 21 and 21'. Since the elements in the area of the connector section 2 are separated as such, it is ensured that the retention or contact forces acting on the pin 30 are always greater than vibration forces introduced into the connector section 2.

Figure 14:
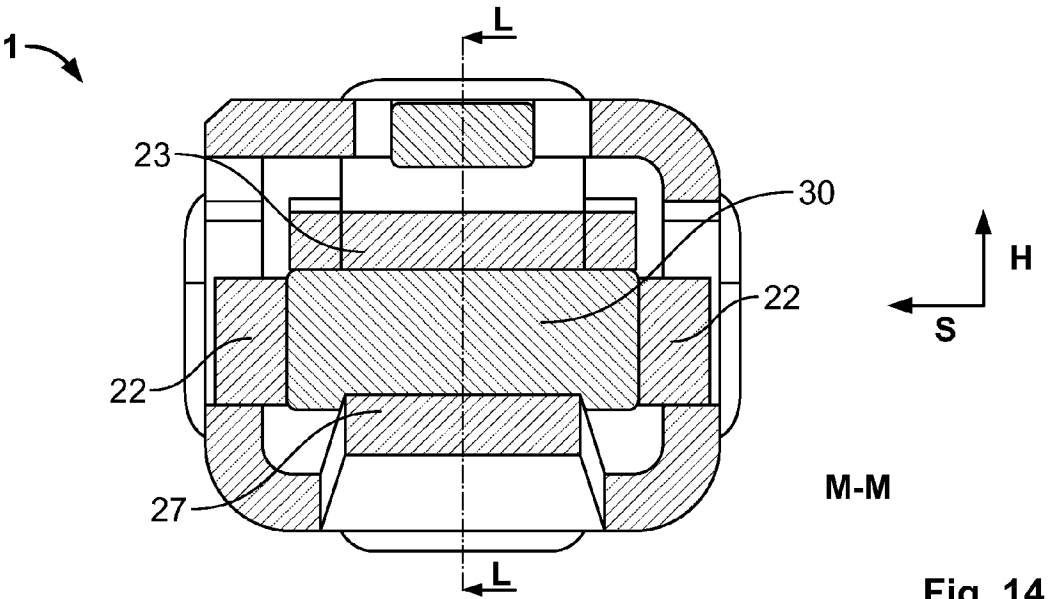
FIG. 14 is a cross-sectional view of a terminal according to the invention with an pin inserted to an end position, along section line M-M in FIG. 13.

FIG. 14 clearly shows that when the pin 30 is fully inserted, or in the inserted position B, the main contact spring 23 and the base 26 of the terminal 1 and the auxiliary contact springs 22 retain the pin 30. Thus, the pin 30 is secured both in the lateral direction S and in the vertical direction H.

Retaining forces acting on a pin 30 inserted into the terminal 1 may be further increased if the terminal 1 has at least one auxiliary contact spring 22, with which a contact force may be exerted on the pin 30 along an auxiliary spring path extending substantially transversely of the insertion direction of the connector section 2 and of the main spring deflection path F. The auxiliary contact spring 22 exerts an additional retaining or contact force on the pin 30. This may be advantageous in particular if any torsional or rotational movements of the pin 30 in the terminal 1 are to be prevented. Additionally, the at least one auxiliary contact spring 22 may act as a limit stop. Thus, the main contact spring 23 may be blocked or locked with the assistance of the auxiliary contact spring 22. The lock may be released on insertion of the pin 30 into the terminal 1 and reactivated upon withdrawal of the pin 30, whereby the mechanisms triggered in the terminal 1 upon insertion of the pin 30 are reversible.

If the pin 30 is removed again from the terminal 1, i.e. from the situation illustrated in FIGS. 13 and 14, the main contact spring 23 and the auxiliary contact springs 22 effect a movement sequence which is the reverse of the insertion process. Thus, when the pin 30 is withdrawn from the terminal 1, first of all the main contact spring 23 drops and the auxiliary contact springs 22 then rest against the shoulders 34 of the main contact spring 23.

Modifications of the above-described embodiments are possible within the concept of the invention. The use of auxiliary contact springs 22 in addition to a main contact spring 23 is wholly optional. Pre-tensioning of the auxiliary and main contact springs 22, 23 is also not mandatory. Pre-tensioning increases the clamping forces, so improving retention of the pin 30 in the terminal 1.

Both the main contact spring 23 and the auxiliary contact spring 22 may be supported with the assistance of a support area 33 against the terminal 1 or against a resilient platelike cantilever 8 formed on the terminal 1. Separate shoulders 34 may also be formed in the terminal 1 for an auxiliary contact spring 22, so defining the auxiliary spring path N of the auxiliary contact spring 22. As on the main contact spring 23, a plurality of contact points 31, 31' may also be formed on the auxiliary contact spring 22 in any desired embodiment.

Fitting of an outer body 9 on the terminal 1 is optional. Latching arms 13 or positioning guides 12 formed on the outer body 9 may likewise be formed on the terminal body 19 itself. Use of an outer body 9 simplifies separation with regard to vibration of contact retention section 17 serving in fastening the terminal 1.

Any fixing mechanisms of the terminal 1, such as, for example latching arms 13 or positioning members, may be formed on the outer body 9. In this way, the contact retention section 17 of the terminal 1 may be of minimal size, which allows material to be saved or structural space to be reduced and provides more design options and space on the terminal 1 for the functional elements thereof.

To separate the contact retention section 17 or a crimping section 4 with regard to vibration from the connector section 2, structural elements other than the notches 20 illustrated here may also be selected. When providing straining zones 16 and flex points 21, a user should ensure that these fulfill the stability requirements of a terminal 1 according to the invention despite their resilience and that, in constructing them, the current-carrying cross-sections of the terminal 1 are always sufficiently large for them not to constitute conduction bottle collars or elevated conduction resistances.

According to the invention, the at least one main contact spring 23 extends substantially in the insertion direction and has a free end directed substantially away from an contact opening 15 of the connector section 2 for inserting of the pin 30 into the connector section 2 and has at least one support area, with which the main contact spring 23 rests in an inserted position against the terminal 1, and in that the terminal 1, retained in the contact retaining area, is received in an outer body 9 fitted to the terminal 1 as a separate component. This design has a number of advantages. First of all, the pin 30 cannot bump against the free end of the main contact spring 23 on insertion through the contact receiving opening 5 into the connector section 2, avoiding bending or damaging it. When, in the insertion position, a pin 30 has been fully inserted into the terminal 1, the spring force may be increased as a result of the main contact spring 23 resting against the additional bearing. Thus, the contact force exerted by the main contact spring 23 on the pin 30 does not have to be absorbed solely at a root 24 of the main contact spring 23, but rather is additionally dissipated via the bearing.

Furthermore, receiving the terminal 1 in an outer body 9 has the additional advantage that the terminal 1 may be received in vibratory manner in the outer body 9, which serves to fasten the terminal 1 in the electrical connector. In addition, elements, such as for example latching arms, which would otherwise have to be arranged on the terminal 1 itself, may be formed on the outer body 9.

A terminal 1 according to the invention may be readily manufactured in automated manner or on an industrial scale in particular when, according to a further possible advantageous development of a terminal 1 according to the invention, the terminal 1 is formed in one piece from a metal part. This also saves on material and reduces costs.

In addition, a one-piece configuration of a terminal 1 according to the invention is advantageous when it comes to omitting any electrical connection points on the terminal 1 which could be disadvantageous for the electrical conductivity of the terminal 1.

Besides these, the configurations described in the above-described embodiment can be selected optionally or can be changed appropriately in to other configurations without departing from the spirit and scope of the present invention.

The invention claimed is:

1. A terminal for an electrical connector, comprising:

an outer body;

a connector section for receiving a pin;

a crimping section;

a contact retention section, the outer body retained in the contact retention section and fitted as a separate component;

a contact receiving area; and at least one main contact spring having a free end and at least one support area, the at least one main contact spring projecting into the contact receiving area for the pin and providing a contact force on the pin along a main spring path extending substantially transversely to the insertion direction of the connector section;

wherein the at least one main contact spring extends substantially in the insertion direction, the free end being directed substantially away from a contact opening of the connector section for inserting the pin into the connector section, and the at least one support area rests against the terminal in an inserted position;

wherein the connector section and the contact retention section are connected by an articulated connection, and the contact retention section and the crimping section are rigidly connected together.

2. The terminal according to claim 1, further comprising a straining zone formed by at least one articulated connection wherein deformation occurring as a result of relative motion between the connector section and the contact retention section is concentrated.

3. The terminal according to claim 1, further comprising a root of the at least one main contact spring arranged in an area which is retained on the connector section by an articulated connection.

4. The terminal according to claim 1, further comprising a contacting area arranged on the contact receiving area substantially opposite the at least one main contact spring and projecting into the contact receiving area, the contacting area retaining the pin between the main contact spring and the contacting area.

5. The terminal according to claim 1, wherein the articulated connection is a material bridge formed in one piece from the connector section and the contact retention section.

6. The terminal according to claim 5, wherein the articulated connection includes a substantially planar material bridge.

7. The terminal according to claim 5, wherein a cross-section of the terminal in a region of the articulated connection is reduced at least relative to other regions of the connector section.

8. The terminal according to claim 1, further comprising a limit stop arranged in the projection of the at least one main contact spring along the main spring deflection path.

9. The terminal according to claim 8, wherein the limit stop is at least one auxiliary contact spring applying a force on the pin along an auxiliary spring path extending substantially transversely of the insertion direction of the connector section and of the main spring deflection.

10. The terminal according to claim 8, further comprising at least one shoulder formed on the at least one main contact spring, the shoulder rests on the limit stop.

11. The terminal according to claim 10, wherein the at least one shoulder of the main contact spring is the limit stop for an auxiliary contact spring.

12. The terminal according to claim 11, wherein the at least one main contact spring is positioned in a projection of the at least one auxiliary contact spring along the spring deflection path on which the auxiliary contact spring rests in the initial position.

13. The terminal according to claim 1, wherein the at least one support area rests against a top of the terminal in the inserted position.

14. The terminal according to claim 13, wherein the terminal includes a resilient platelike cantilever against which the at least one support area rests in the inserted position.

15. The terminal according to any claim 1, further comprising at least two contact points formed on the at least one main contact spring for contacting the pin.

16. The terminal according to claim 15, wherein the at least one support area is positioned between the contact points or at the free end of the at least one main contact spring.

17. The terminal according to claim 15, wherein the at least one support area is positioned between the contact points and at the free end of the at least one main contact spring.

18. The terminal according to claim 1, further comprising at least one positioning guide.

19. The terminal according to claim 18, further comprising a latching arm extending in the longitudinal direction.

20. The terminal according to claim 19, further comprising a free end of latching arm, the free latching end movable in a latching direction extending transversely of the longitudinal direction.

21. The terminal according to claim 20, wherein the latching arm arranged with the outer body.

22. The terminal according to claim 20, wherein the latching arm is divided at least in two parts in the longitudinal direction and the at least one positioning guide extends at least section-wise between the at least two parts of the latching arm.

23. The terminal according to claim 1, further comprising a retaining point and a clamp recesses of the contact retention section.

24. The terminal according to claim 23, wherein the outer body grips the terminal with a first clamp and fastens to the terminal using a second clamp around the clamp recess.

25. A terminal for an electrical connector, comprising:

an outer body;

a connector section for receiving a pin;

a crimping section;

a contact retention section, the outer body retained in the contact retention section and fitted as a separate component;

a contact receiving area;

at least one main contact spring having a free end and at least one support area, the at least one main contact spring projecting into the contact receiving area for the pin and providing a contact force on the pin along a main spring path extending substantially transversely to the insertion direction of the connector section;

a limit stop arranged in the projection of the at least one main contact spring along the main spring deflection path; and at least one shoulder formed on the at least one main contact spring, the shoulder rests on the limit stop;

wherein the at least one main contact spring extends substantially in the insertion direction, the free end being directed substantially away from a contact opening of the connector section for inserting the pin into the connector section, and the at least one support area rests against the terminal in an inserted position.

26. The terminal according to claim 25, wherein the limit stop is at least one auxiliary contact spring applying a force on the pin along an auxiliary spring path extending substantially transversely of the insertion direction of the connector section and of the main spring deflection.

27. The terminal according to claim 25, wherein the at least one shoulder of the main contact spring is the limit stop for an auxiliary contact spring.

28. The terminal according to claim 27, wherein the at least one main contact spring is positioned in a projection of the at least one auxiliary contact spring along the spring deflection path on which the auxiliary contact spring rests in the initial position.

29. A terminal for an electrical connector, comprising:

an outer body;

a connector section for receiving a pin;

a crimping section;

a contact retention section, the outer body retained in the contact retention section and fitted as a separate component;

a contact receiving area; and at least one main contact spring having a free end and at least one support area, the at least one main contact spring projecting into the contact receiving area for the pin and providing a contact force on the pin along a main spring path extending substantially transversely to the insertion direction of the connector section;

wherein the at least one main contact spring extends substantially in the insertion direction, the free end being directed substantially away from a contact opening of the connector section for inserting the pin into the connector section, and the at least one support area rests against the terminal in an inserted position;

wherein the at least one support area rests against a top of the terminal in the inserted position;

wherein the terminal includes a resilient platelike cantilever against which the at least one support area rests in the inserted position.

30. A terminal for an electrical connector, comprising:

an outer body;

a connector section for receiving a pin;

a crimping section;

a contact retention section, the outer body retained in the contact retention section and fitted as a separate component;

a contact receiving area;

at least one positioning guide;

a latching arm extending in the longitudinal direction;

a free end of latching arm, the free latching end movable in a latching direction extending transversely of the longitudinal direction; and at least one main contact spring having a free end and at least one support area, the at least one main contact spring projecting into the contact receiving area for the pin and providing a contact force on the pin along a main spring path extending substantially transversely to the insertion direction of the connector section;

wherein the at least one main contact spring extends substantially in the insertion direction, the free end being directed substantially away from a contact opening of the connector section for inserting the pin into the connector section, and the at least one support area rests against the terminal in an inserted position;

wherein the latching arm is divided at least in two parts in the longitudinal direction and the at least one positioning guide extends at least section-wise between the at least two parts of the latching arm.

* * * * *